US005899671A

United States Patent [19]

Horn

[11] Patent Number: 5,899,671

[45] **Date of Patent: * May 4, 1999**

[54] HYDRAULIC DRIVEN DIAPHRAGM PUMP WITH MECHANICAL DIAPHRAGM STROKE LIMITATION

[75] Inventor: Waldemar Horn, Wimsheim, Germany

[73] Assignee: Lewa Herbert Ott GmbH & Co., Leonberg, Germany

[ * ] Notice: This patent is subject to a terminal disclaimer.

[21] Appl. No.: 08/879,023

[22] Filed: Jun. 19, 1997

Related U.S. Application Data

[63] Continuation of application No. 08/291,921, Aug. 18, 1994, abandoned.

[30] Foreign Application Priority Data

Aug. 19, 1993 [DE] Germany ..... 43 27 970

[51] Int. Cl.[6] ..... F04B 9/08

[52] U.S. Cl. ..... 417/387; 417/388; 92/97; 92/100

[58] Field of Search ..... 417/383, 385, 417/386, 387, 388; 92/97, 99, 100

[56] References Cited

U.S. PATENT DOCUMENTS

| | | | |
|---|---|---|---|
| 1,101,266 | 6/1914 | Franklin | 417/388 |
| 2,919,650 | 1/1960 | Wiggermann | 417/386 |
| 3,075,468 | 1/1963 | Eifel | 417/388 |
| 3,277,829 | 10/1966 | Burgert | 417/387 |
| 4,741,252 | 5/1988 | Harter et al. | 92/98 |
| 4,828,464 | 5/1989 | Maier et al. | 417/388 |
| 4,865,528 | 9/1989 | Fritsch et al. | 417/388 |
| 4,883,412 | 11/1989 | Malizard et al. | 417/387 |
| 5,246,351 | 9/1993 | Horn et al. | 417/387 |

FOREIGN PATENT DOCUMENTS

| | | |
|---|---|---|
| 2 492 473 | 10/1980 | France . |
| 23 33 876 | 2/1977 | Germany . |
| 28 43 054 | 11/1987 | Germany . |
| 40 18 464 | 12/1991 | Germany . |
| 41 41 670 | 9/1994 | Germany . |

*Primary Examiner*—Charles G. Freay

*Attorney, Agent, or Firm*—Jacobson, Price, Holman & Stern, PLLC

[57] ABSTRACT

For a hydraulically driven diaphragm pump with a diaphragm consisting of at least two individual layers, these layers are clamped at least in their central area between a coupling part on the feed area side and the hydraulics area side and are thus mechanically linked with one another. The coupling parts are also connected with a relay valve of a leak replenishment system which is attached in the pump body in a moveable manner.

5 Claims, 2 Drawing Sheets

HYDRAULIC DRIVEN DIAPHRAGM PUMP WITH MECHANICAL DIAPHRAGM STROKE LIMITATION

This application is a file wrapper continuation of application Ser. No. 08/291,921, filed Aug. 18, 1994, now abandoned.

FIELD OF THE INVENTION

The invention deals with a hydraulic driven diaphragm pump.

BACKGROUND OF THE INVENTION

It is of extreme importance for maintaining faultless operation of hydraulic driven diaphragm pumps that the allotted quantity of hydraulic fluid is always present in the hydraulic area, that the proper diaphragm motion is ensured and that strain which could lead to damage of the diaphragm is avoided.

It is known from DE-PS 23 33 876 that a leak replenishment device controlled by the diaphragm system can be designed in order to compensate for the hydraulic fluid deficit in the hydraulic area. This means that the diaphragm itself activates the operation of a control valve, whereby a relay valve which is linked with the diaphragm and is attached in a movable manner within the pump body opens a connection in the intake stroke end position from a storage chamber for the hydraulic fluid to the hydraulic area. Leak replenishment can and should only be then carried out if the diaphragm has reached a predetermined boundary position at the end of the intake stroke.

Additional designs of this type of leak replenishment devices for diaphragm pumps are described in DE-PS 28 43 054 as well as in FR-PS 24 92 473.

The control of leak replenishment by the diaphragm system offers numerous advantages in comparison to pressure controlled leak replenishment with a blow valve. In this manner, high suction levels can be overcome on the one hand, with the suction level being limited by the steam pressure of the delivery fluid and hydraulic fluid alone. On the other hand, overloading of the hydraulic area can be avoided, as can occur with pressure controlled leak replenishment through vacuum points. This type of distinctive vacuum points mainly present themselves with large high pressure diaphragm pumps at the beginning of the suction phase if the fluid columns in the suction line are accelerated in a jerky manner upon opening of the upstroke valve. Finally, leak replenishment controlled by the diaphragm system enables hydraulic fluid to be drawn forward upon low differential pressure of less than 0.3 bar as an example, with absolute pressure remaining at approximately 0.7 bar. As a result, gas accumulation in the hydraulic area can largely be avoided which offers corresponding advantages with respect to feed performance and precision. In contrast, pressure controlled leak replenishment requires a relatively high adjustment of the differential pressure at the blow valve to the extent of 0.6 bar, for example, in order to ensure reliable operation. The resulting decrease in pressure in the hydraulic area during the drawing process of 0.4 bar in absolute pressure, for example, leads to increased gas accumulation. This results in decreased feed performance and precision.

It has nonetheless been shown in practice that this known diaphragm pump still has certain weaknesses whose elimination is desirable. For example, before the initial operation of the pump it must be made sure that the diaphragm is in no case displaced too far in the direction of the feed area with respect to the pistons.

Furthermore, only a predetermined amount of hydraulic fluid can be located in the hydraulic area, because too much hydraulic fluid would lead to stress or even the bursting of the diaphragm when the first piston pressure stroke is executed. An incorrect amount of hydraulic fluid in the hydraulic area can nonetheless be expected if during a break in operation a vacuum has appeared at the blow valve or the pressure valve of the feed area. The vacuum present at the blow valve, for example, can reproduce itself through the statically not very thick blow valve in the feed area as well as in the hydraulic area and can lead to the hydraulic fluid being sucked through the piston sealing from the storage chamber to the hydraulic area.

In order to avoid the diaphragm having to be manually repositioned every time before starting the diaphragm pump to prevent damage to the diaphragm, it is already known from DE-OS 41 41 670 that diaphragm stroke limitation can be provided both in the intake stroke as well as the pressure stroke boundary position of the diaphragm. This ensues in the intake stroke boundary position in a purely mechanical manner, namely by means of a support plate against which the diaphragm lies in the intake stroke boundary position. In the pressure stroke boundary position, the diaphragm stroke limitation is however carried out purely hydraulically, in that a valve part, which is located on the piston end of the relay valve of a leak replenishment device, breaks off the hydraulic connection from the piston working area to the diaphragm working area, with the surplus hydraulic oil being forced out through a pressure control valve in the storage chamber.

What it problematic here though is that the hydraulic diaphragm stroke limitation being used is relatively costly and no display device is included which would signal damage or the rupture of the diaphragm.

In order to be able to carry out monitoring of the condition of the diaphragm, it is already known for a diaphragm pump of the same type (DE-OS 40 18 464) to make the diaphragm as a sandwich diaphragm, with the diaphragm consisting of two individual layers held at a distance from each other. The gap between the individual layers is connected with a display device which reacts as soon as the fluid pressure increases upon the break of an individual layer—either from the feed area or from the pressure area—into the diaphragm gap. With regards to this known diaphragm pump, in order to avoid the reciprocal lifting of the individual layers which particularly occurs in the intake stroke, these are connected to numerous locations, particularly through welding, which is nonetheless relatively costly from a technical standpoint and can lead to the splitting of these connections when exposed to high vacuum levels.

SUMMARY OF THE INVENTION

Based on this state of the art, the task of the invention is to provide for a diaphragm pump in such a manner that it has high operational reliability and prevents in a simple and reliable manner a reciprocal lifting of the diaphragm individual layers in the intake stroke.

With respect to the diaphragm pump as set out by the invention, the individual layers of the diaphragm are clamped at a minimum in their central area between a coupling part on the feed area end and on the hydraulic area end and are thereby mechanically connected. Furthermore, the coupling parts are connected with a relay valve of a diaphragm controlled leak replenishment device which is attached in the pump body in a moveable manner.

Through the arrangement of the coupling parts in the central area of the diaphragm as set out by the invention, the operational reliability of a hydraulically driven diaphragm pump is dramatically increased. This is a result of the fact that the diaphragm area encompassed by the coupling parts is accordingly reinforced, so that the diaphragm is not subject here to any bending strain whatsoever. With a proper design of the coupling parts, it can furthermore be ensured that the diaphragm is admitted in a dynamically balanced manner which significantly contributes to the protection of the diaphragm. This is further supported by the fact that the diaphragm is led through the relay valve of the leak replenishment device in a controlled manner. Additionally, the coupling parts also provide additional protection of the diaphragm from a chemical perspective in that they offer protection against aggressive media in addition to the protection provided from a mechanical perspective, in that they decrease the mechanical strain of the diaphragm in their main area of strain through the medium to be fed through. The coupling parts also act as protective elements if the diaphragm strikes against the corresponding stop faces of the pump body or the pump cover in the intake stroke or pressure stroke boundary position.

A particular advantage lies in the fact that a reciprocal lifting of the diaphragm layers is reliably prevented during the intake stroke by the coupling parts as set out by the invention. Any potentially resulting impairment of the suction line and pump line can accordingly be safely avoided. Furthermore, pressure changes between the diaphragm layers through the reciprocal lifting of the diaphragm layers can be avoided which can trigger the reaction of a connected diaphragm rupture display device despite the absence of any diaphragm leaks.

For purposes of effectiveness, the coupling parts are formed as stopper elements which together with the feed area limiting wall of the pump cover as well as that of the pump body act as stop faces for mechanical pressure stroke and intake stroke limitation. Due to this type of arrangement, diaphragm stroke limitation ensues on both sides of the diaphragm in a purely mechanical manner, so that hydraulic stoke limitation devices, for limitation of the pressure stroke for example, are unnecessary.

In an effective design of the invention, the coupling parts are formed in such a way that together with the related surfaces of the pump body and the pump cover they each form one of the diaphragm support surfaces conforming with the natural geometry of the diaphragm and are essentially continuous. Such a design significantly contributes to the protection of the diaphragm.

For purposes of effectiveness, the coupling parts are formed as dynamically balanced support plates with particularly flat front surfaces. The flat front surface facing away from the diaphragm acts as a large surface stop face in the pressure stroke or intake stroke boundary position, whereas the flat front surface facing the diaphragm is formed as a large surface stop face for the diaphragm.

In accordance with an advantageous design of the invention, the coupling part on the feed area side is coated with a synthetic material. The synthetic coating protects the coupling part on the pressure stroke side from aggressive media on one hand and on the other hand can be covered in such a way so as to act as an attenuator if the coupling part strikes against the pump cover in the pressure stroke boundary position.

A simple reciprocal connection of both coupling parts enables the coupling part on the feed area side to bear a rod-like attachment part which passes through central through-holes in the diaphragm and the coupling part on the hydraulics side and is attached to the relay valve. An additional advantage here lies in the fact that the relay valve has a continuous bore hole through which the rod-like attachment part passes so that it can be attached to the end of the relay valve facing the displacement piston.

A simple design results if the coupling part on the hydraulics side is formed as an integral, or single piece, with the relay valve.

For purposes of effectiveness, the radius of at least the coupling part on the feed area side is equal to or greater than the half radius of the section of the diaphragm present in the feed area. As a result, large stop faces or support surfaces are obtained which decreases the mechanical pressure load on the coupling parts, the pump body or pump cover as well as on the diaphragm, and simultaneously guarantees that the individual diaphragm layers are securely held together.

In a particularly advantageous design of the invention, the coupling part on the feed area side is sized and arranged in such a way that it covers up at least the largest part of the mouths of the inlets and outlets. As a result, the diaphragm is also mechanically supported in the area of the inlets and outlets when the diaphragm is located in the pressure stroke boundary position, whereby it can be avoided that the diaphragm is pressed into the inlets and outlets resulting in a "shooting through" of the diaphragm in these positions. It is thereby directly possible to generously size the inlets and outlets and to arrange them in such a way that they lead into the feed area in a central area, that is, in the area of the largest diaphragm strokes. As a result, the loss of pressure within the pump is reduced to a minimum and the effectiveness of the pump is increased so that highly viscous fluid can also be transported. Furthermore, the flow through of the feed area is forced through the separated inlets and outlets so that the pump can also be used for fluids containing solid matter and food substances, with the through flow being indispensable for a good cleansing effect during flushing processes.

The inlets and outlets lead into the feed area in an advantageous manner, such that the center gap from the center line of the feed area is a maximum of 50% of the largest feed area radius.

The loss of pressure inside the pump can furthermore be reduced in an advantageous manner if the inlets and outlets are lined up parallel to the direction of movement of the diaphragm in the area of the mouths on the feed area side.

Since the coupling part is usually dimensionally stable, it is advantageous if the individual layers of the diaphragm have a bead in the area between the coupling part and the side restraint. The side permits the desired moveability of the diaphragm on one hand and on the other hand is sufficiently stiff in order to prevent the reciprocal lifting of the individual diaphragm layers in the intake stroke.

In addition, a region of a pumping-space-delimiting wall disposed between the inlet channel and the outlet channel is configured as a flat abutting surface for the pumping-side-space coupling member.

For purposes of effectiveness, the pump cover contains a ventilation hole which leads into the feed area at its geodetically highest point and is connected with the outlet. This ventilation hole, which is relatively small in comparison with the inlets and outlets, serves the purpose of ventilating the feed area.

It is additionally advantageous if the pump cover contains an escape hole for solid matter which leads into the feed area at the geodetically lowest point and is connected to the inlet. This hole serves the purpose of draining off sedimentary particles in order to prevent that these become caught between the pump cover and the diaphragm leading to damage on the diaphragm.

For purposes of effectiveness, the hydraulics area is connected with a pressure control valve due to the fact that when starting up the pump it can occur, as earlier mentioned, that the diaphragm or the coupling part can lay against the pump cover. If the piston moves further in the direction of its pressure stroke end position or if a certain maximum pressure is exceeded, surplus hydraulic oil is drained off through the pressure control valve into the storage chamber. The diaphragm subsequently works again in its normal working area.

BRIEF DESCRIPTION OF THE DRAWINGS

The invention is explained in more detail with the following drawings. These show in FIG. 1 a diaphragm as set out by the invention, schematically in cross-section and FIG. 2 an enlarged schematic depiction of the diaphragm spanning between the coupling parts, with the coupling part on the feed area side being coated with synthetic material.

DETAILED DESCRIPTION OF THE PREFERRED EMBODIMENTS

Figure 1:
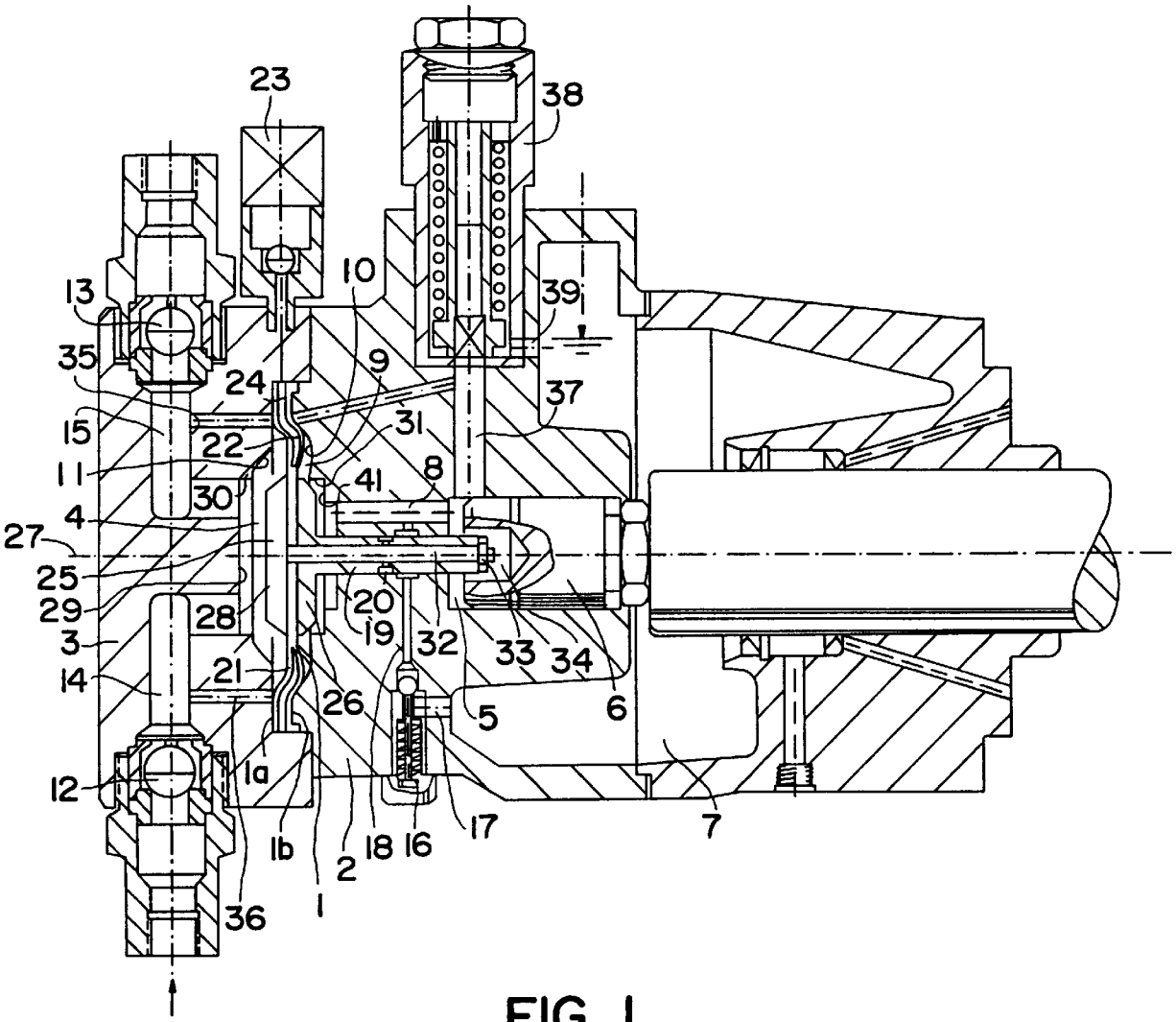

In FIG. 1, a hydraulically powered diaphragm pump can be seen which has a diaphragm 1 consisting of two individual layers 1*a*, 1*b* separated from each other and particularly made of synthetic material. These are clamped on their side between the pump body 2 as well a pump cover 3 detachably fixed to the pump body on the front side and separates a feed area 4 from a hydraulic area 5 filled with hydraulic fluid which represents the piston working area.

The diaphragm pump has a diaphragm drive in the form of an insulated oscillating displacement piston 6, which is movable in the pump body 2 between the piston working area 5 and a storage chamber 7 for the hydraulic fluid. The piston working area 5 is connected with a pressure area 9 on the side of the diaphragm by means of at least one axial bore hole 8 present in the pump body 2 which represents the diaphragm working area and together with the piston working area 5 forms the hydraulic area. As can be seen, the diaphragm working area 9 is bordered on one side by the diaphragm 1 and on the other side by a rear (piston side) spherical cap 10. This rear limiting cap 10 is formed by the corresponding front surfaces of the pump body 2 and represents a part of the mechanical stop face against which the diaphragm 1 lies at the end of the intake stroke.

Across from the limiting cap 10 on the piston side is a limiting cap 11 made up of the front surfaces of the pump cover 3 in the feed area 4. The pump cover 3 is designed in the usual way with an inlet valve 12 (upstroke valve) as well as an outlet valve 13 (pressure valve). These two valves 12, 13 are connected with the feed area 4 by means of a inlet 14 and outlet 15 in such a way that the feed medium upon the intake stroke of the displacement piston going towards the right (as it is depicted in FIG. 1) with the diaphragm 1 being drawn into the feed area through the upstroke valve and the inlet 14. In contrast, upon the pressure stroke of the diaphragm 1 going towards the left (as it is depicted in FIG. 1) the feed medium is carried out from the feed area 4 in measured amounts through the outlet 15 and the pressure valve 13.

In order to prevent the appearance of cavitation at the end of the diaphragm intake stroke and in order to provide necessary leakage replenishment due to losses from leakage, a leak replenishment device is included. This has a normal spring-loaded blow valve 16 which is connected with the storage chamber 7 through a channel 17 and through channel 18 and the connecting channel 8 with the piston working area 5 on one side and with the diaphragm working area 9 on the other side.

The leak replenishment is controlled by a control valve which has a relay valve 19. This is attached on the same axis with the displacement pistons 6 in the area of the connecting canal 8 between the diaphragm working area 9 and the piston working area 5 in a moveable manner in a corresponding bore hole of the pump body 2. An orbiting nut 20 is provided on a determined location of the circumference of the relay valve which provides the connection in the intake stroke end position of the diaphragm 1 between the sniffing valve 16 of the leak replenishment device and the hydraulic area 5, 9—through channels 18, 8.

The individual layers 1*a*, 1*b* of the diaphragm 1 are dynamically balanced and have beads 21 in their area near the sides, which enable free moveability of the layers 1*a*, 1*b* between their intake stroke and pressure stroke end position. The individual layers 1*a*, 1*b* run at a distance from each other in the area of these beads 21 so that a diaphragm gap 22 is formed. This diaphragm gap 22 serves the purpose in the event of a rupture of one of the diaphragm layers 1*a*, 1*b* of quickly signaling the rupture of the diaphragm by means of a corresponding display system 23 which is connected with the diaphragm gap 22. The diaphragm gap 22 is formed by holding the diaphragm layers 1*a*, 1*b* at a distance with a ring 24 in their side clamping area. This ring 24 is set with one or more channels (not depicted) which produce the connection between the diaphragm gap 22 and the internal functions of the diaphragm rupture display system 23.

In contrast to their side areas, the individual layers 1*a*, 1*b* of the diaphragm 1 do not run at a distance in their middle area, rather are held close to each other by coupling parts on both sides in the form of discoid support plates 25, 26. The support plates 25, 26 are essentially mirror-inverted and central to the center line 27 of the relay valve 19.

The support plate 25 on the feed area side has a flat front surface 28 facing the pump cover which lies parallel to a likewise flat front surface 29 of the pump cover 3. This front surface 29 of the pump cover 3 is located between the mouths of the inlet 14 and outlet 15 in the feed area 4 and serve as a stop face for the support plate 25 in the pressure stroke boundary position.

The diameter of the support plate 25 on the feed area side, that is, its extension in a radial direction, is measured in such a way that the support plate 25 completely covers up the mouths of the inlets and outlets 14, 15, so that these mouths are sealed in the pressure stroke boundary position of the diaphragm 1 from the support plate 25. The support plate 25 in this pressure stroke boundary position lies in an axial bore hole 30 of the pump cover 3, so that the flat support surface of the support plate 25 lying on the diaphragm 1, together with the radial outer lying area of the cap 11 of the pump cover 3 forms a support surface conforming to the natural geometry of the diaphragm and almost gap free.

The essentially mirror-inverted support plate 26 on the side of the hydraulics area enters into an axial bore hole 31 of the pump body 2 in the intake stroke boundary position of the diaphragm 1, whereby the front surface of the support plate 26 facing the displacement piston 6 strikes against a front surface 41 of the pump body 2. The flat support surface of the support plate 26 lying on the diaphragm layer 1*b* together with the radial outer lying diaphragm working area-limitation area of the cap 10 also forms one of the support surfaces for the diaphragm layer 1*b* conforming with the natural geometry of the diaphragm and almost gap free. The support plate 26 is designed integrally with the relay valve 19, that is, is molded to it.

The support plate 25 on the feed area side is secured to the support plate 26 on the hydraulic area side or to the relay valve 19 by means of a rod-like attachment part 32 which extends through the central through-holes within the diaphragm layers 1*a*, 1*b* of the support plate 26 on the hydraulic area side and of the relay valve 19, and is attached to the end of the relay valve 19 facing the displacement piston 6 by means of a nut 33.

In order not to limit the movement area of the displacement piston 6, the displacement piston 6 contains a front-facing axial bore hole 34 whose diameter is larger than that of the relay valve 19. In this manner, the displacement piston 6 can move outwards in the direction of the diaphragm 1 through the protruding end of the relay valve 19.

The inlet and outlet 14, 15 are line up in such a way that they run parallel to the center line 27 of the relay valve 19 in the area of their mouths and thus parallel to the direction of movement of the diaphragm 1. Since they are relatively close to the center line 27, they lie in the area of the largest stroke motion of the diaphragm 1, so that a forced through flow of the feed area 4 is achieved.

At the geodetically highest point of the feed area 4, at least one pressure-resistant small bore hole 35 is included which leads into the outlet 15. This bore hole serves the purpose of ventilating the feed area 4.

Additionally, the geodetically lowest point of the feed area 4 also contains at least one pressure-resistant small bore hole 36 which leads into the inlet 14. The purpose of this bore hole 36 is to drain off sedimentary particles in order to prevent them from getting caught between the pump cover 3 and the diaphragm and causing damage to the diaphragm 1.

During normal operation, the diaphragm 1 works at a distinct gap from the limiting cap 11 in the pump cover 3, so that the diaphragm 1 is not strained by the mechanical system. When starting up the pump, it can nevertheless occur that the diaphragm moves outward over its pressure stroke end position to its pressure stroke boundary position at which point the support plate 25 strikes on the front surface 29 of the pump cover 3, with the diaphragm 1 lying against the support surface in the pump cover 3. If the displacement piston moves further in the direction of its pressure stroke end position or a certain determined maximum pressure is exceeded, surplus hydraulic fluid is drained off through a channel 37 and through a pressure control valve 38 linked to it as well as a channel 39 into the storage chamber 7. If during start up of the pump the diaphragm 1 first moves outward over its intake stroke end position up to its intake stroke boundary position, at which point the support plate 26 strikes on the front surface 41 of the pump body 2, with the diaphragm 1 laying itself against the support surface in the pump body 2, hydraulic fluid is then drawn from the storage chamber through the blow valve 16 and the relay valve 19. There is nonetheless purely mechanical support of the diaphragm 1 in both boundary positions over the support plates 25, 26, which simultaneously ensure a secure reciprocal connection of the diaphragm layers 1*a*, 1*b*.

Figure 2:
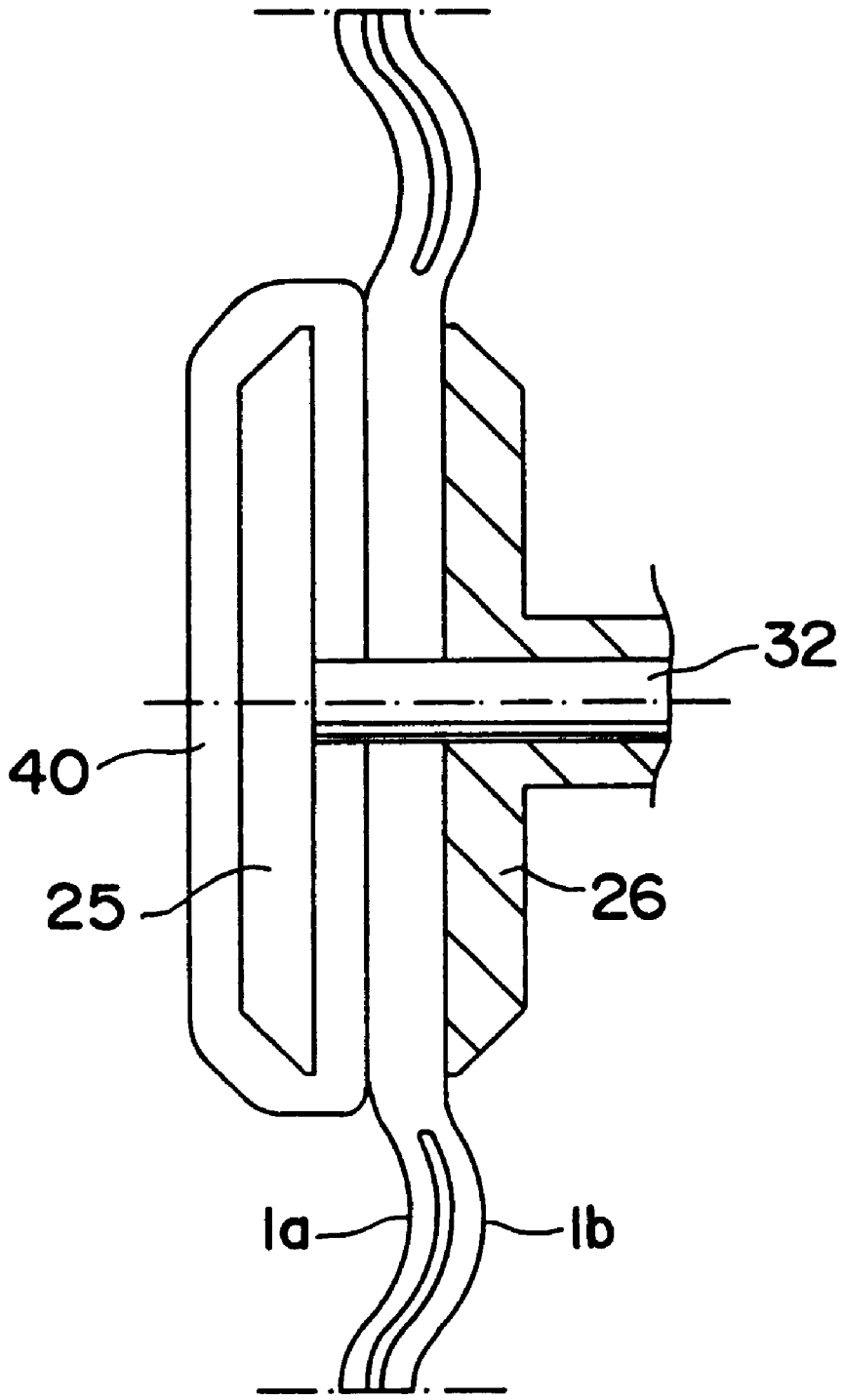

With the design depicted in FIG. 2, the support plate 25 on the feed area side is completely coated with a synthetic material 40 which has a shock absorbent effect when the support plate 25 strikes the front surface 29 of the pump cover 3 and can be made in such a way that the support plate 25 is protected against aggressive media. Likewise with respect to this design, the diaphragm layers 1*a*, 1*b* are tightly held together in their central area by means of a support plate 25, 26, so that they are not able to be separated from one another during the intake stroke.

I claim:

1. A hydraulically driven membrane pump for a pumpable medium, said pump comprising:

a membrane having edges held by a ring between a pump housing and a pump cover, said membrane including at least two individual layers separating a pumping space from a hydraulic compression space, said pumping space, wherein pumping is performed on the pumpable medium, has an inlet channel and an outlet channel separate from said inlet channel, said membrane being reciprocally movable between a suction stroke position and a compression stroke position by a hydraulic membrane drive in the form of a reciprocating pumping piston, and said layers of the membrane being clamped, at least in a central region of said membrane, whereby said layers are clampingly held between a pumping-space-side coupling member and a hydraulic-compression-space-side coupling member, and thereby said layers are mechanically bound together, said coupling members being connected to a sliding control member slidably disposed in the pump housing, said control member being part of a leak-compensating device, and said coupling members having engaging surfaces engaging a pumping-space-delimiting wall of the pump cover as well as the pump housing to mechanically limit the compression stroke and suction stroke, respectively, of the membrane, the pumping-space-side coupling member having a rod-like fastening member extending through a central throughgoing bore in the membrane layers and through a throughgoing longitudinal bore in the control member, and said fastening member being fastened to an end of said control member directed toward the pumping piston.

2. A membrane pump according to claim 1, wherein the pumping-space-side coupling member is coated with a plastic coating.

3. A membrane pump according to claim 1, wherein the hydraulic-compression-space-side coupling member is of a unitary construction with the sliding control member.

4. A membrane pump according to claims 1, wherein a radius of at least the pumping-space-side coupling member is equal to or greater than one-half a radius of a portion of the membrane disposed in the pumping space.

5. A membrane pump according to claim 1, wherein a region of a pumping-space-delimiting wall disposed between the inlet channel and the outlet channel is configured as an abutting surface for the pumping-space-side coupling member, wherewith said surface is flat.

* * * * *